United States Patent [19]

Loevinger

[11] Patent Number: 4,530,288

[45] Date of Patent: Jul. 23, 1985

[54] HEATED RAILWAY TANK CAR

[76] Inventor: Richard P. Loevinger, P.O. Box 68, Brandon, S. Dak. 57005

[21] Appl. No.: 583,834

[22] Filed: Feb. 27, 1984

[51] Int. Cl.[3] ..... B61D 5/00; B61D 27/00

[52] U.S. Cl. ..... 105/358; 105/451; 126/378; 165/41; 165/169

[58] Field of Search ..... 105/358, 360, 451; 126/343.5 A, 378; 137/347, 350; 165/41, 169; 280/5 C, 5 D, 5 E, 5 G

[56] References Cited

U.S. PATENT DOCUMENTS

| | | | |
|---|---|---|---|
| 2,545,371 | 3/1951 | Mojonnien et al. | 165/169 |
| 3,143,108 | 8/1964 | Rogers | 126/343.5 A |
| 3,176,764 | 4/1965 | Barbera | 280/5 E |
| 3,228,466 | 1/1966 | Carleton | 105/451 |
| 3,338,185 | 8/1967 | Phillips | 105/358 |
| 3,595,307 | 7/1971 | Mowatt-Larssen et al. | 165/169 |
| 3,685,458 | 8/1972 | Price et al. | 105/358 |
| 3,742,866 | 7/1973 | Needham et al. | 105/360 |
| 4,476,788 | 10/1984 | Loevinger | 105/358 |
| 4,480,370 | 11/1984 | Loevinger | 165/41 |

*Primary Examiner*—Louis J. Casaregola
*Attorney, Agent, or Firm*—Richard J. Myers

[57] ABSTRACT

A sloped heat exchange element is sealingly mounted above the bottom of the tank of a railway tank car adjacent each end of the tank. Each heating element is thermally isolated from the tank cradles and bolsters, which detrimentally act as heat sinks in conventional heated tank cars. The sloped heat exchangers can be manufactured into the car or retrofit into tank cars not previously having heat coils or they can be retrofit into tank cars having either internal or external heating coils.

9 Claims, 9 Drawing Figures

3
5
9
11
11'
15
17
19
21
21'
24
24'
25
25'
26
26'
27
27'
28
28'
29
51
52
53
54
54'
55
56
57
58
59
60
61
80
90

HEATED RAILWAY TANK CAR

BACKGROUND OF THE INVENTION

Reference is hereby made to commonly owned U.S. Pat. No. 4,476,788, granted Oct. 16, 1984, and U.S. Pat. No. 4,480,370, granted Nov. 6, 1984, and the teachings of these patents are herein incorporated by this reference.

FIELD OF THE INVENTION

This invention relates to heat exchange elements installed in the tank of railway tank cars to heat the contents of the tank and thereby promote flow of liquid from the tank.

DESCRIPTION OF THE PRIOR ART

Liquids hauled in railway tank cars often are of the type which are highly viscous at low ambient temperatures. To decrease the viscosity of such liquids, such as molasses, prior art tank cars have been provided with fluid flow passages affixed to, or adjacent to, the walls of the tank. A heated fluid medium, such as steam, hot water or hot oil, is passed through these passages to heat the contents of the tank and thereby decrease the viscosity of the contents to promote and accelerate flow of the contents from an outlet valve normally located at the bottom center of the tank.

The prior art passages or heat coils have generally been attached to the bottom and side and, less frequently, to the top walls of the tank and have generally been mounted in a substantially horizontal position.

Disadvantages of these prior art heating elements are (1) they tend to overheat the top portion of the liquid lading and do not provide sufficient heat to the bottom portion of the lading adjacent the valve through which the heated contents must flow, (2) water tends to remain trapped in the heat exchange passages which can cause corrosion, blockages and/or rupture due to freezing, (3) heavy masses of metal, such as tank cradles and car bolsters, affixed to the tank serve as heat sinks which absorb heat and radiate it to the air to cause a build-up or heel of solidified lading on the bottom of the tank which causes a loss of some of the lading and decreases the capacity of the tank for subsequent ladings and, as the heel serves as an insulator, decreases the efficiency of the heating elements and (4) overheating of the lading is detrimental to some liquids, such as those having a high sugar content which tend to solidify or carmelize upon being overheated.

The patent applications referenced above disclose a tank car heat exchanger which extends from each end of the car adjacent the bottom of the tank to the center positioned valve and slopes from the ends to the valve to provide a sloped surface to promote flow of the liquid towards the valve as it progressively decreases in viscosity and causes a rolling action of the liquid as the heated liquid rises upwardly from adjacent the heat exchange elements toward the top of the tank. These heat elements are sealingly engaged with the walls of the tank car and a dead air space between the sloped heating element and the bottom of the tank thermally isolates the heating elements from the tank cradles and bolsters to minimize or substantially eliminate the undesirable heat sink effects of these components. These heat exchangers perform extremely well, but by extending the full length of the car, the lading carrying capacity of the car decreases and the weight of the car increases.

SUMMARY OF THE INVENTION

A sloped heat exchange element is mounted adjacent each bottom end of a railway tank car and extends only partially toward the bottom center of the car to thermally isolate the heating elements from the tank cradles and bolsters of the car and promote liquid flow toward the bottom center mounted outlet valve of the tank. As these heat elements connect to heat passages affixed to the internal or external bottom wall of the tanks, they optimize the cargo capacity of the tank and decrease the weight added to the car by the heat exchanger. These heat exchangers can be built into tanks at the time of initial manufacture or they can be retrofit to the tanks of used cars already having internal or external heating coils.

DETAILED DESCRIPTION OF THE PREFERRED EMBODIMENT

Figures 1, 2, 3:
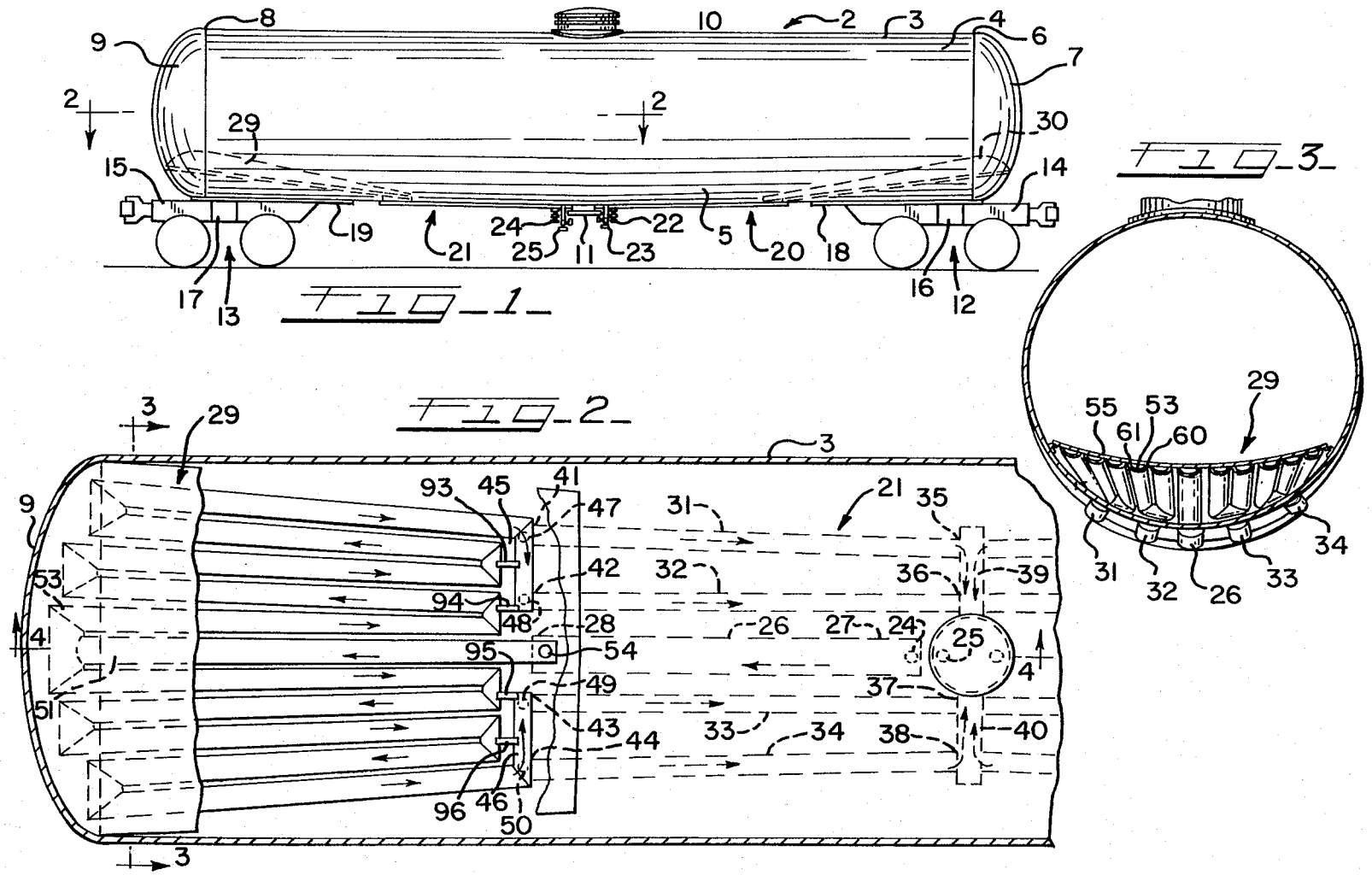
FIG. 1 is an elevation view of a tank car having the heat exchanger arrangement of this invention.
FIG. 2 is a top sectional view of a portion of the tank of the tank car shown in FIG. 1, as indicated by the section line 2—2.
FIG. 3 is an end sectional view of just the tank of the tank car in FIG. 2, as indicated by the section line 3—3.

FIG. 1 is a side elevation view of a railway tank car 2. Tank car 2 is comprised of a tank 3 which is substantially cylindrical and has a top portion 4, a bottom portion 5, a first end portion 6 sealingly closed by a first end closure member 7 and a second end portion 8 sealingly closed by a second end closure member 9.

Tank 3 is provided with a lading or cargo inlet means, such as access hatch 10, and a lading or cargo outlet means, such as outlet valve 11.

Adjacent each bottom portion of the end of the tank a wheel truck assembly, such as conventional, well-known wheel trucks 12 and 13, are typically provided to rollingly support the tank.

Structure connecting the tank to the wheel trucks is typically comprised of a stub center sill 14 and 15, a laterally extending bolster 16 and 17 rigidly affixed to a center sill and a tank support and connection means, such as a tank cradle 18 and 19, which is rigidly engaged to each a stub sill and a bolster to maintain tank 3 mounted on wheel truck assemblies 12 and 13.

Adjacent the tanks intermediate bottom portion and extending substantially longitudinally away from outlet valve 11 is a pair of heat exchanger assemblies 20 and 21. Each of the heat exchanger assemblies 20 and 21 is comprised of a plurality of interconnected fluid conducting passages or ducts sealingly engaged to the exterior surface of the wall of tank 3. Assemblies 20 and 21 may be fabricated during initial building of the car, added to an unheated car or they may be formed using previously existing heat coils modified to work in conjunction with the structure of this invention.

Adjacent outlet valve 11 an inlet means, such as inlet pipe 22, and an outlet means, such as outlet pipe 23, is provided for heat exchanger assembly 20. Similarly, an inlet pipe 24 and an outlet pipe 25 is provided for heat exchange assembly 21.

As best shown in FIG. 2, in which a top sectional view of substantially half of tank 3 is shown, heat exchange assembly 21 is comprised of an inlet duct 26 which has a first end portion 27 which is in fluid flow communication with inlet pipe 24 and a second end portion 28 which is in fluid flow communication with a sloped heat exchange assembly 29. As shown in FIG. 1, a sloped heat exchange assembly 29 and 30 is positioned adjacent the bottom end portion of each end of the tank 3.

Figures 4, 8, 9:
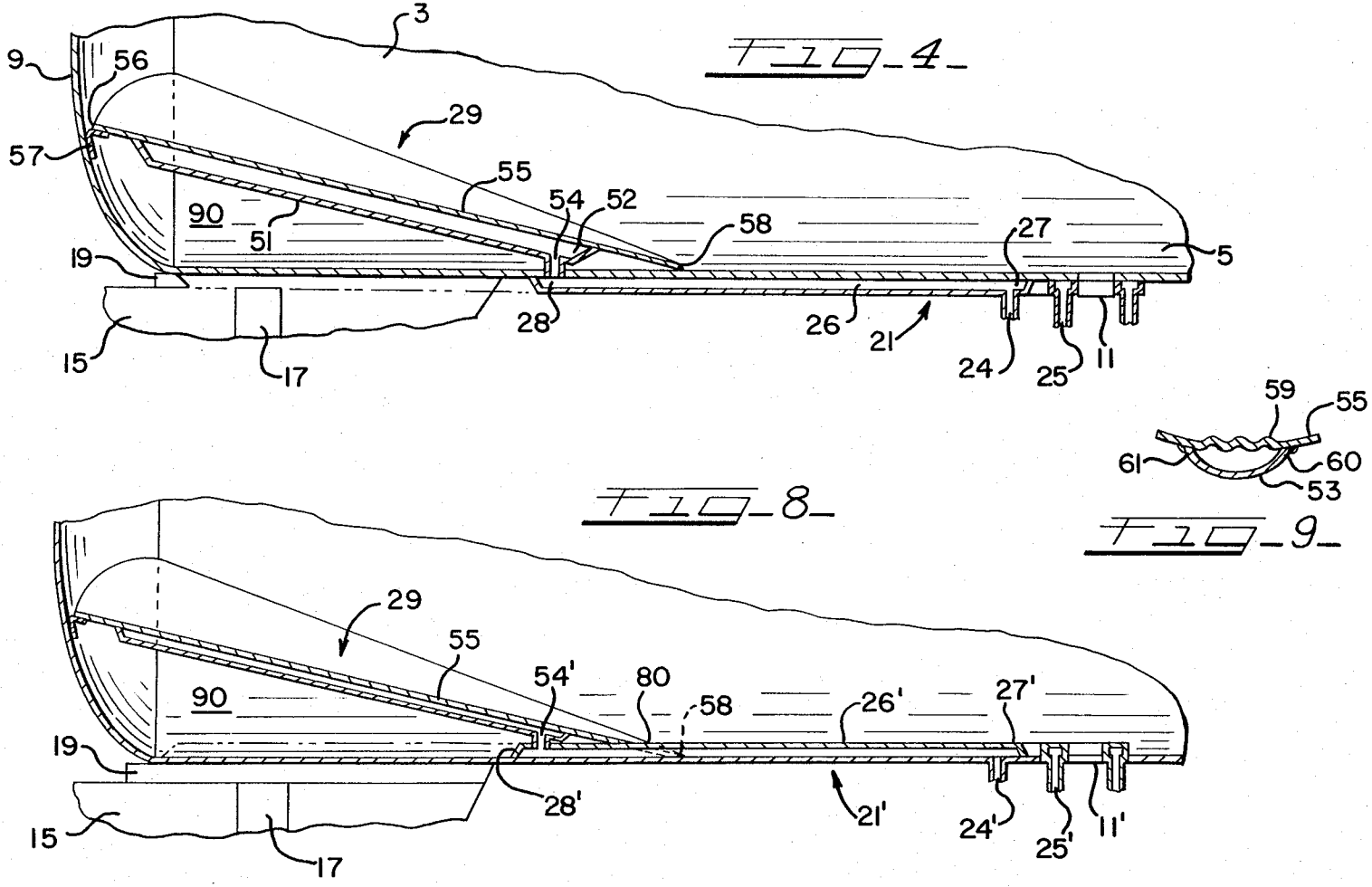
FIG. 4 is a sectional, partial elevation view of FIG. 3 as indicated by the section lines 4—4.
FIG. 8 is a sectional, partial elevation view of FIG. 6 as indicated by the section lines 8-8.
FIG. 9 is an enlarged sectional view of a fluid medium duct of this invention having an increased surface area.

Referring to FIGS. 2, 3, and 4 heat exchange assembly 21 is comprised of a plurality of fluid conveying passageways or ducts, such as ducts 31, 32, 33 and 34. Each of these ducts has a first end 35, 36, 37 and 38, respectively, which places it in fluid flow communication with outlet pipe 25 via appropriate outlet means, such as outlet manifolds 39 and 40.

Each of these ducts also has a second end portion 41, 42, 43 and 44 respectively which places it in fluid flow communication with sloped heat exchange assembly 29 via outlet manifolds 45 and 46 and connective pipes 47, 48, 49 and 50.

Sloped heat exchange assembly 29 is comprised of an inlet duct 51 having a first end portion 52 connected in fluid flow communication with second end 28 of inlet duct 26 of heat exchange assembly 21. Inlet duct 21 is serially connected to a plurality of interconnected, substantially serpentine or sinuously arranged fluid flow ducts, such as duct 53, which are arranged to carry a heated fluid medium from an inlet connective pipe 54 to and fro along the sinuous path until the fluid medium flows into outlet manifolds 45 and 46 and back into heat exchange assembly 21, essentially as indicated by the flow areas.

Ducts 53 are arranged in a suitable pattern, such as in a serpentine or sinuous fashion, as shown, and sealingly affixed, such as by welding, to a metal plate 55, as best shown in FIGS. 3 and 4.

Though the edge portion 56 of plate 55 may be welded in sealing engagement completely around its periphery to the walls and end members of the tank it is preferable to sealingly engage a mounting member, such as member 57 to the tank end and walls and affix the plate 55 to the member 57.

Longitudinally inward end 58 is directly welded to the tank wall along the bottom or lower portion of the tank.

As shown in FIG. 9, plate 55 may have a plurality of selectively positioned surface deformations, such as upwardly extending annular dimples 59, placed in it to increase the surface area of plate 55 which is exposed to lading placed in the tank 3. These deformations could be of other suitable configurations, such as corrugations, which extend longitudinally along the path of the ducts or passageways 53. Any such deformations should be selectively positioned in plate 55 so they are not positioned in the areas where the mating edges, such as edges 60 and 61, of any of the ducts engage and are sealingly affixed to the plate 55.

FIGS. 5, 6, 7 and 8 show an alternate embodiment of the heat exchanger structure shown in FIGS. 1, 2, 3 and 4 and described above.

Figures 5, 6, 7:
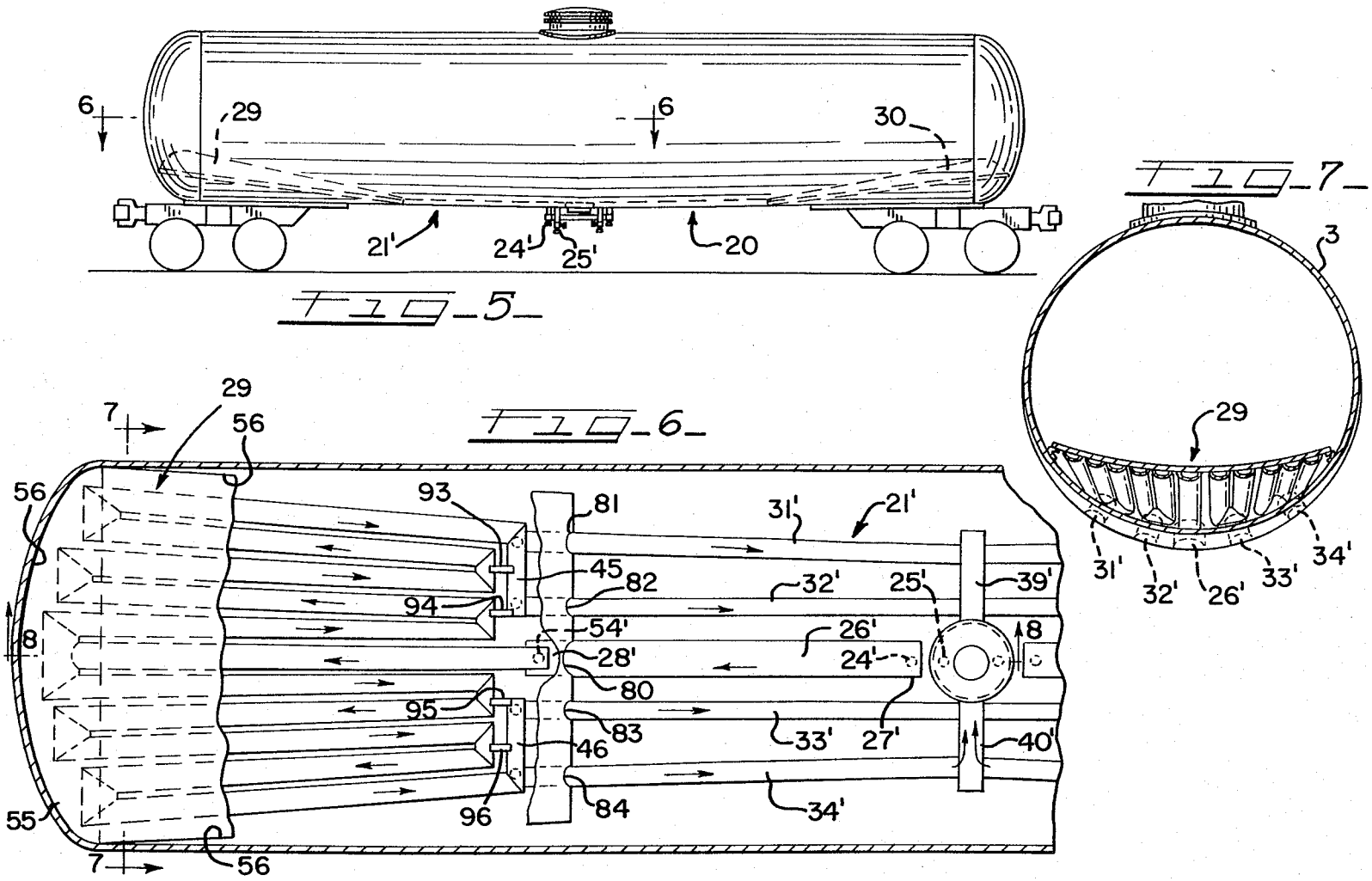
FIG. 5 is an elevation view of a tank car having an alternate embodiment of the heat exchanger arrangement of this invention.
FIG. 6 is a top sectional view of a portion of the tank of the tank car shown in FIG. 5, as indicated by the section line 6—6.
FIG. 7 is an end sectional view of just the tank of the tank car shown in FIG. 6, as indicated by the section line 7—7.

Referring to FIGS. 5, 6 and 8 it will be seen that heat exchange assemblies 20' and 21' are placed within tank 3 and are sealingly engaged with the interior surface of the tank rather than the exterior surface, as shown in FIGS. 1 through 4.

Assemblies 20' and 21' are essentially identical to assemblies 20 and 21. Assembly 21', as shown in FIGS. 6 and 8 has an inlet duct 26' and a plurality of ducts 31', 32', 33' and 34'.

Inlet duct 26' has a first end 27' in fluid flow communication with an inlet pipe 24' and a second end 28' placed in fluid flow communication with a sloped heat exchanger 29 by suitable connective means such as connection pipe 54'.

Ducts 31', 32', 33' and 34' place outlet manifolds 45 and 46 of sloped exchanger 29 in fluid flow communication with outlet manifolds 39' and 40' which are also sealing engaged to the interior surface of the wall of tank 3.

The outlet manifolds are connected to an outlet pipe 25' to enable a spent heating medium to flow from the heat exchanger.

Outlet valve 11 intrudes or extends slightly further into the interior of the tank, as best shown in FIG. 8 compared to FIG. 4.

As best shown in FIGS. 6 and 8, having the ducts of assembly 21' on the interior surface of the tank wall requires that portions of plate 55 of heat exchanger 29 be notched out adjacent end 58 of plate 55 to provide coped or conforming edges which enable the end 58 to be continuously sealingly engaged to the upper and side surfaces of ducts 26', 31', 32', 33' and 34' and to the portion of the tank wall extending between these ducts.

These cutaway portions provide conforming edges such as 80, 81, 82, 83 and 84 to enable the end 58 to be sealingly engaged to the tank. Other than the cutaway portions adjacent edge 58 of plate 55 heat exchanger assembly 29 may be exactly as described for the first embodiments shown in FIGS. 1, 2, 3, and 4.

Just as with assemblies 20 and 21, assemblies 20' and 21' are essentially mirror images of each other.

As most clearly seen in FIGS. 4 and 8, sloped heat exchanger, 29 and 30 provide a dead air space, such as dead air space 90, between the plate 55 and the bottom of the car and the heating passages formed of inlet passage or duct 51 and serpentine or sinuous serially arranged ducts 53 are positioned in the dead air space and substantially thermally isolated from the heavy metal masses of the tank cradle, stub sill and tank cradle. Thus, these heavy metal masses do not detrimentally serve as heat sinks to absorb and waste heat provided by the sloped heat exchange elements 29 and 30.

Heat exchange assemblies 29 and 30 and external or internal heat exchange assemblies 20 and 21 or 20' and 21', respectively, may be manufactured into the tank at the time of initial build or retrofit to an unheated tank.

Also, the sloped heat exchangers can be prefabricated and provided in substantially a kit form for retrofit into used tank cars requiring reconditioning in which the tanks have an internally or externally positioned heating system. In the instances the heat exchanger assemblies 20 or 21 or 20' and 21' would be comprised of the existing heat coils which would be sealed off at the second end, such as adjacent ends 41, 42, 43 and 44 of ducts 31, 32, 33 and 34, respectively, and adjacent end 28 of inlet passage 26, and the portions of the heat coils between these sealed off ends and the end of the car, as indicated generally in phantom lines in FIGS. 4 and 8, can remain dormant on the tank as they may be removed, such as by cutting off with a welding torch.

Connective pipes such as 47, 48, 49, 50 and 54 are added to sealingly connect the portion of the ducts to be used with appropriate portions of the newly added slope heat exchange assembly, such as assembly 29.

When it is desired to remove the contents of the tank through the outlet valve 11, a source of a heated fluid such as hot water, oil or steam is connected to the inlets 22 or 24 and forced to flow through the heat exchange assemblies adjacent the valve, through the sloped heat exchanger, back through the outlet passages of the heat exchange assemblies adjacent the valve 11 to exit the system through outlets 23 and 25. The spent heating medium may either be dumped to the ground or recycled through the heat source to again flow through the heating assemblies.

Flow of the heated medium through the heat exchange assemblies efficiently heats the lading in the tank and consequently decreases its viscosity to promote its flow through outlet valve 11 into an appropriate receiving means, not shown.

The sloped heat exchangers promote flow of the lading toward the center end outlet valve of the tank, enable the lading to drain completely from plate 55 to minimize or eliminate formation of a "heel" build-up of the material on the sloped heat exchangers, which decreases the lading capacity of the tank and also decreases the heating efficiency of the sloped heat assemblies, while eliminating the heat sink effort of the heavy metal masses due to the thermally isolating dead air space 90.

A plurality of condensate flow or drainage pipes are preferably provided in each sloped heat exchange assembly. These drainage pipes, such as pipe 93, 94, 95 and 96 shown in FIGS. 2 and 6, enable the condensate to readily flow from the sloped heat assemblies to aid in preventing blockage in these assemblies due to a build up of water or ice.

As shown in FIG. 3 and 7, the bottom portion of the tank is sloped toward the outlet valve 11 so the condensate tends to drain from assemblies 20 and 21.

While the sloped exchange assemblies may be positioned at a variety of slopes they are preferably positioned at a slope in the range of four percent (4%) to sixteen percent (16%) to assure complete drainage of lading and condensate.

The heated medium flow ducts of the heat exchanger assemblies 29 and 30 may be positioned on the under side of the plates. The ducts could also be positioned on the upper or top surface of the plates. Placement of the ducts on the upper surface would remove the ducts from the dead air space and position them further away from the bottom of the tank. Thus, less heat would be dissipated to the bottom of the tank and due to direct contact between the lading and the curved walls of the ducts heat input into the lading over a greater surface area would result.

What is claimed is:

1. In a railway tank car having a tank mounted on tank cradles adjacent bolsters for wheel trucks, said tank having two closed ends and a substantially cylindrical wall having a bottom portion with a cargo outlet valve mounted on said bottom portion intermediate said closed ends, an improved cargo heating means comprising:

first means for heating affixed to said bottom portion of said tank adjacent said outlet valve and extending toward each end of said tank and having a terminal portion intermediate said valve and each of said ends of said tank;

second means for heating sealingly engaged with each end of said tank above said bottom portion of said tank and slopingly extending to sealingly engage said bottom portion of said tank adjacent said terminal portion of said first means, said second heating means being sealingly engaged with said tank for forming a dead air space between said second means and said bottom portion of said tank;

first connective means for placing said first means in fluid flow communication with said second means for enabling a heated fluid to flow through said first means and said second means for heating a liquid cargo contained in said tank above said first and said second means; and second connective means for placing said first heating means in fluid flow communication with a source of heated fluid for causing said heated fluid to flow into and out of said heating means.

2. The invention as defined in claim 1 together with a substantially annular fluid flow passage substantially surrounding said outlet valve and in fluid flow communication with said first heating means for heating a liquid in said tank adjacent said outlet valve.

3. The invention as defined in claim 1 in which said first means for heating is comprised of a plurality of fluid flow passage members affixed to the bottom portion of said tank on the interior of said tank.

4. The invention as defined in claim 1 in which said first means for heating is comprised of a plurality of fluid flow passage members affixed to the bottom portion of said tank on the exterior of said tank.

5. The invention as defined in claim 1 in which said second means for heating is comprised of a plate of metal having a substantially sinuous fluid flow passage sealingly affixed to said plate and the peripheral edges of said plate are affixed in sealing engagement with said tank for forming a dead air space beneath said plate.

6. The invention as defined in claim 5 in which said fluid flow passage is affixed to the bottom side of said plate for being in said dead air space.

7. The invention as defined in claim 5 in which said fluid flow passage is a plurality of interconnected members sealingly engaged to said plate by welding.

8. The invention as defined in claim 5 in which said plate of metal has integral surface deformations formed on it for increasing surface area.

9. The invention as defined in claim 8 in which said deformations are a plurality of raised dimples extending upwardly from said plate.

* * * * *